US007138613B1

(12) United States Patent
Walsh et al.

(10) Patent No.: US 7,138,613 B1
(45) Date of Patent: Nov. 21, 2006

(54) GOLF BALL HEATER

(76) Inventors: Scott Michael Walsh, 13060-C Laurel Tree La., Herndon, VA (US) 20171; George Matthew White, 13060 C Laurel Tree La., Herndon, VA (US) 20171; James Joshua Nichols, 2325 E. Iowa St., Evansville, IN (US) 47711

( * ) Notice: Subject to any disclaimer, the term of this patent is extended or adjusted under 35 U.S.C. 154(b) by 0 days.

(21) Appl. No.: 11/193,784

(22) Filed: Jul. 29, 2005

(51) Int. Cl.
*H05B 3/06* (2006.01)

(52) U.S. Cl. ..... 219/521; 219/385; 219/386; 219/392

(58) Field of Classification Search ..... 219/521, 219/385, 386, 392, 523, 528, 529
See application file for complete search history.

(56) References Cited

U.S. PATENT DOCUMENTS 3,624,346 A * 11/1971 Guth ..... 219/201
3,683,155 A 8/1972 Loofbourow
4,049,949 A 9/1977 Fitzsimons
4,155,002 A 5/1979 Cohen
4,420,681 A 12/1983 Arnold
4,545,362 A 10/1985 Hendricks
4,967,062 A 10/1990 Cohen
5,057,670 A 10/1991 Cohen
5,062,528 A * 11/1991 Whitaker, Jr. ..... 206/315.3
5,137,011 A * 8/1992 Roth ..... 126/263.01
5,860,415 A 1/1999 Waters et al.
5,915,373 A 6/1999 Malover et al.
5,998,771 A 12/1999 Mariano et al.
6,130,411 A 10/2000 Rockenfeller et al.

FOREIGN PATENT DOCUMENTS

GB 2384997 A * 8/2003

* cited by examiner

*Primary Examiner*—Robin O. Evans
*Assistant Examiner*—Vinod Patel
(74) *Attorney, Agent, or Firm*—Matthew D. Durell

(57) ABSTRACT

The present invention is directed to a golf ball heater comprising a rectangular container, the interior of which is outfitted with at least one heating element and rails for holding golf balls. One end of the container includes a sliding door for retrieving a heated golf ball. On one side of the container, a control box is outfitted with circuitry to cooperatively work with sensors in the container for purposes of selectively activating the heating element(s) according to whether or not the sliding door is open or shut and whether or not the temperature inside the container is within the optimal temperature range.

9 Claims, 6 Drawing Sheets

SECTION II-II

GOLF BALL HEATER

CROSS REFERENCE TO RELATED APPLICATION

None

STATEMENT REGARDING FEDERALLY SPONSORED RESEARCH OR DEVELOPMENT

Not Applicable

FIELD OF THE INVENTION

The invention set forth herein relates to a device for heating golf balls for purposes of increasing the distance the ball will travel when struck with a golf club.

BACKGROUND OF THE INVENTION

It is generally understood that a golf ball will travel significantly further when heated to at least 80° F. Accordingly, devices capable of heating and maintaining golf balls at such temperatures have significant practical utility for golfers in colder regions, where temperatures rarely, if ever, reach or exceed 80° F. Likewise, such devices are useful for all golfers during colder months of the year.

Several prior art devices have been proposed to enable golfers to take advantage of the aforementioned performance benefits associated with heated golf balls. These devices come in a wide array of shapes, sizes and configurations and employ a variety of means for heating golf balls disposed therein, including: chemical (U.S. Pat. Nos. 4,545,362, 5,915,373 and 5,998,771), heated air (U.S. Pat. Nos. 3,683,155, 4,420,681, 4,967,062 and 5,057,670), heated water (U.S. Pat. No. 4,049,949), conduction (U.S. Pat. No. 6,130,411), solar power (U.S. Pat. No. 5,860,415) and radiation (U.S. Pat. No. 4,155,002).

Despite the physical differences between existing golf ball heaters, however, virtually all of the devices disclosed in the above cited patents are deficient in at least one significant respect. None of these devices are equipped to portably, effectively and reliably heat and maintain golf balls within a desired temperature range, particularly over extended periods of play. For example, the heaters disclosed in U.S. Pat. Nos. 4,049,949, 4,155,002, 4,967,062 and 5,057,670 require access to a standard electrical outlet in order for balls to become heated to the desired temperature range. During play, the respective heat sources are disabled and insulation is relied upon to keep the balls heated. Thus, while these devices are equipped to heat golf balls to a desired temperature, it cannot be said that they are capable of portably and effectively maintaining a desired temperature range over an extended period of time.

Prior art heaters employing other means for heating golf balls are similarly ill-equipped and insufficient for heating balls to a specific temperature and portably, effectively and reliably maintaining balls within an a specific temperature range. U.S. Pat. No. 6,130,411 discloses a golf ball heater relying on conductance to heat golf balls to the desired temperature. In addition, this device employs elements facilitating portable heating of golf balls, temperature monitoring and automatic application of heat where the temperature falls under the desired range. Power to the heating means is automatically shut off where the temperature exceeds the desired range. The problem, however, is that the operation of the heating means is independent from the retrieval of a heated ball. That is, where the user opens the device to retrieve a ball and leaves the heater open or fails to fully close the device, the heating means will continue to operate without effectively heating and maintaining the remaining balls within the desired range. Further, the exposed heating means poses a substantial safety risk.

Therefore, it is desirable that a device exist that reliably heats golf balls to a desired temperature, monitors and maintains that temperature, yet avoids the problems and hazards associated with existing golf ball heating devices.

SUMMARY OF THE INVENTION

Accordingly, the present invention is directed at a golf ball heating device that portably, effectively and reliably heats and maintains balls within a desired temperature range. More specifically, the present invention is directed to a golf ball heater comprising a rectangular container, the interior of which is outfitted with at least one heating element and rails for holding golf balls. One end of the container includes a sliding door for retrieving a heated golf ball. On one side of the container, a control box is outfitted with circuitry to cooperatively work with sensors in the container for purposes of selectively activating the heating element(s) according to whether or not the sliding door is open or shut and whether or not the temperature inside the container is within the optimal temperature range.

DETAILED DESCRIPTION OF THE PREFERRED EMBODIMENT

Figure 1:
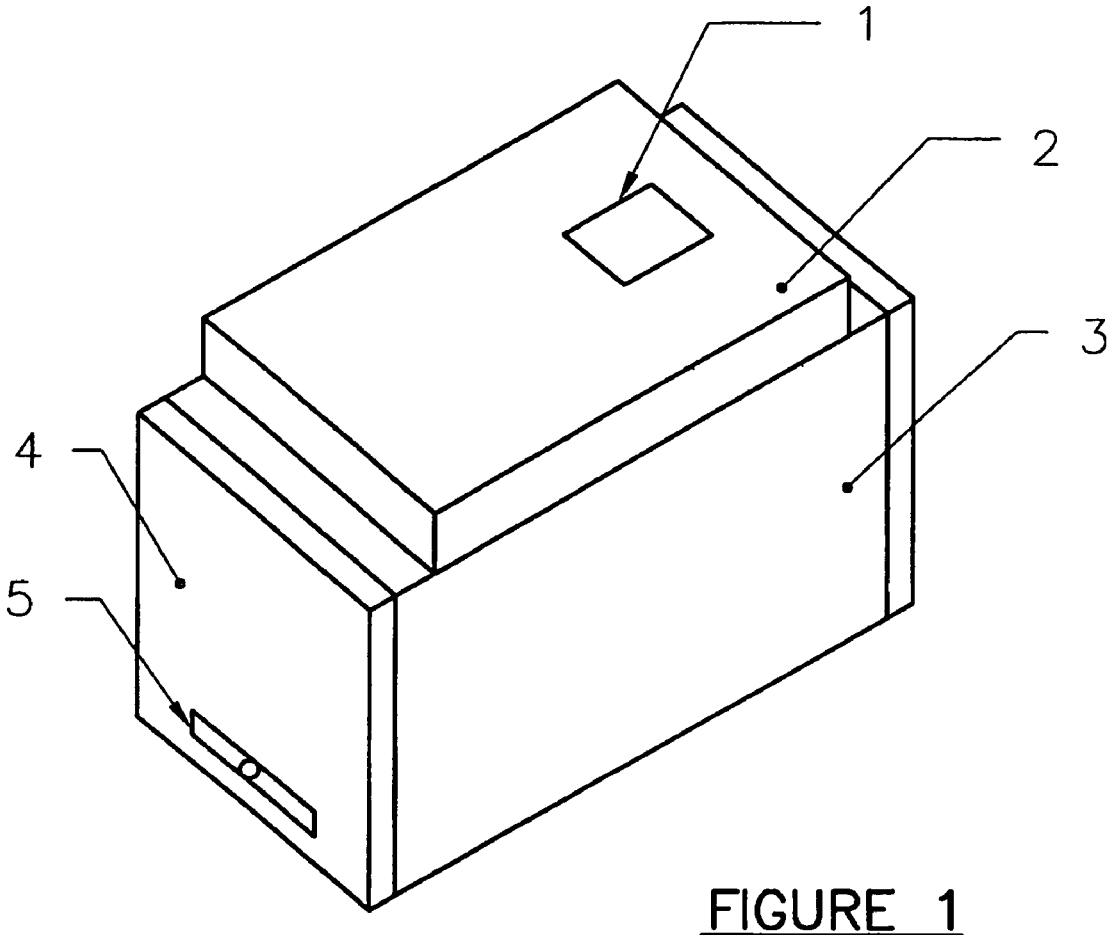
FIG. 1 is an external view of the preferred embodiment of the heating container component of the present invention.

Referring to FIG. 1, the preferred embodiment includes a heating box 3, which facilitates heating and storage of any desired number of golf balls practicable. The heating box 3 is preferably, but not necessarily, rectangular in shape. Nevertheless, it should be understood that the heating box 3 can function in accordance with the present invention while taking on a multitude of shapes and/or dimensions. A sliding door 4 is located at one end of the heating box 3. Next, a control box 2 is affixed to one surface of heating box 3, preferably the top. The control box 2 houses control circuitry 12 and voltage regulator circuitry 11. (See FIG. 4).

The heating box 3 also includes a push button lock 5. Though not pictured, the lock 5 is equipped with any suitable means for interconnecting the lock 5 with the power supply for the thermal resistor(s) 8 supplying heat inside the box 3. The locking mechanism of the push button lock 5 can also be electrically connected to a door open sensor 13 (see FIG. 4) in order to control the flow of electricity to the resistor(s) 8. The flow is shut off when the push button lock 5 is depressed to open the sliding door. As such, where the sliding door is left open, the thermal resistors 8 are prevented from continuing to generate heat. This feature is a valuable safety feature as well.

The preferred embodiment also includes a light emitting diode ("LED") temperature display 1, which displays the temperature inside the heating box 3 and allows the user to easily determine when the golf balls disposed therein are at an appropriate temperature. It should be understood, however, that any practicable means for providing an audio or visual indication of the interior temperature of the box 3 would work equally as well. Alternatively, the temperature indicator 1 can be omitted, as it is not essential to the proper use and/or function of the invention.

Figure 2:
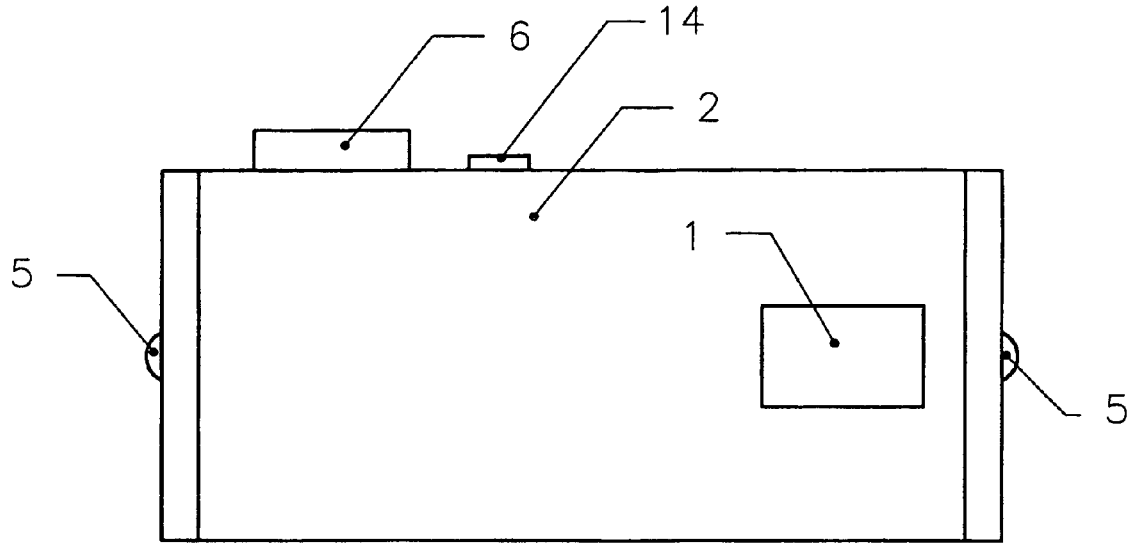
FIG. 2 is a top view of the preferred embodiment of the heating container component of the present invention.
Figure 2A:
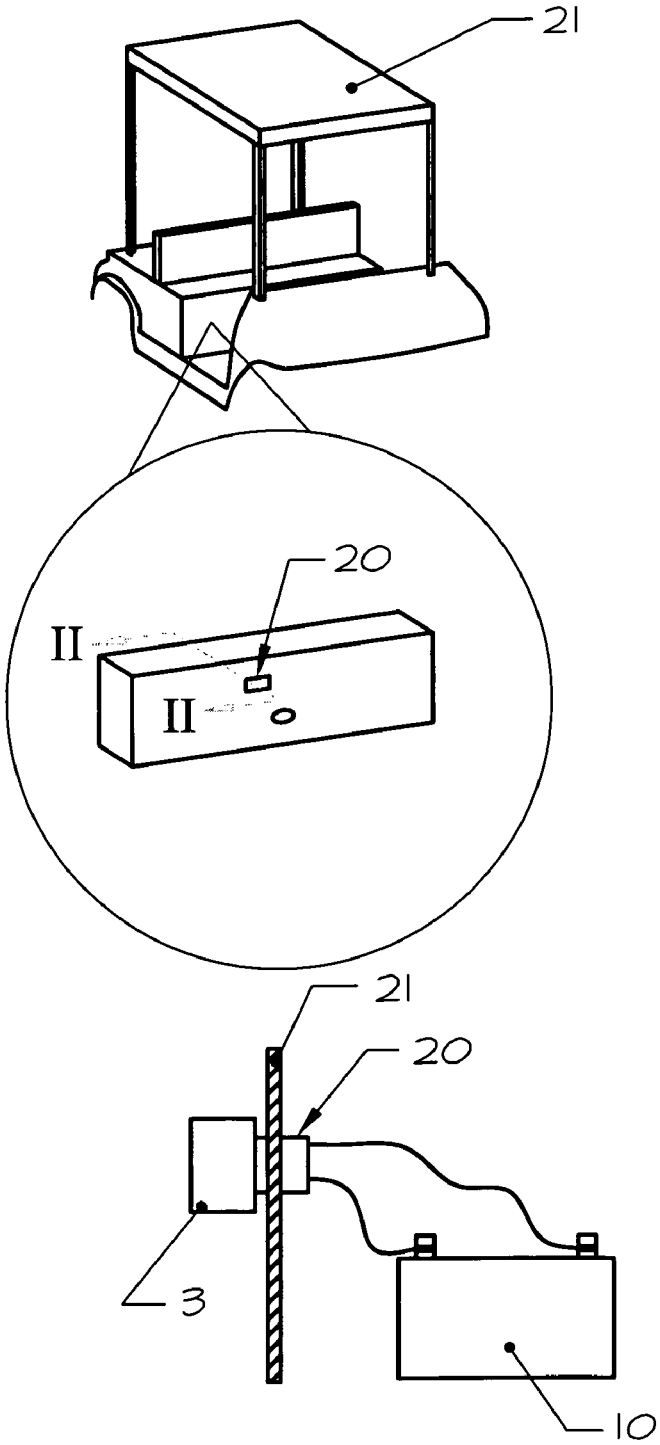
FIG. 2*a* shows the connectivity between the heating container component of the present invention and a golf cart.

Referring now to FIG. 2, the top view of the preferred embodiment reveals that the LED display 1 is preferably, though not necessarily, disposed on top of the control box 2. As seen in FIG. 2*a*, power connector 6 is a male connector, designed to mate with a female connector 20 permanently mounted on a golf cart 21 and hardwired to the golf cart battery 10.

Figure 2B:
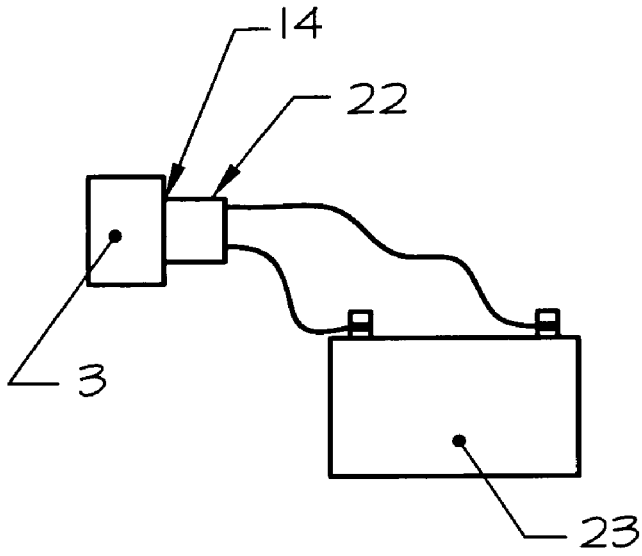
FIG. 2*b* shows the connectivity between the heating container component of the invention and a remote control battery pack.

Alternatively, as seen in FIG. 2*b*, remote control battery connector 14 is also provided and is likewise a male connector suitable for interconnection with a female connector 22 on any remote control ("RC") battery pack 23. In this way, the heater is optionally portable for use by golfers riding suitably equipped golf carts or for use by a walking golfer using an RC battery. Nevertheless, other types of power connectors and adaptors used in any suitable configuration would also be acceptable.

Figure 3:
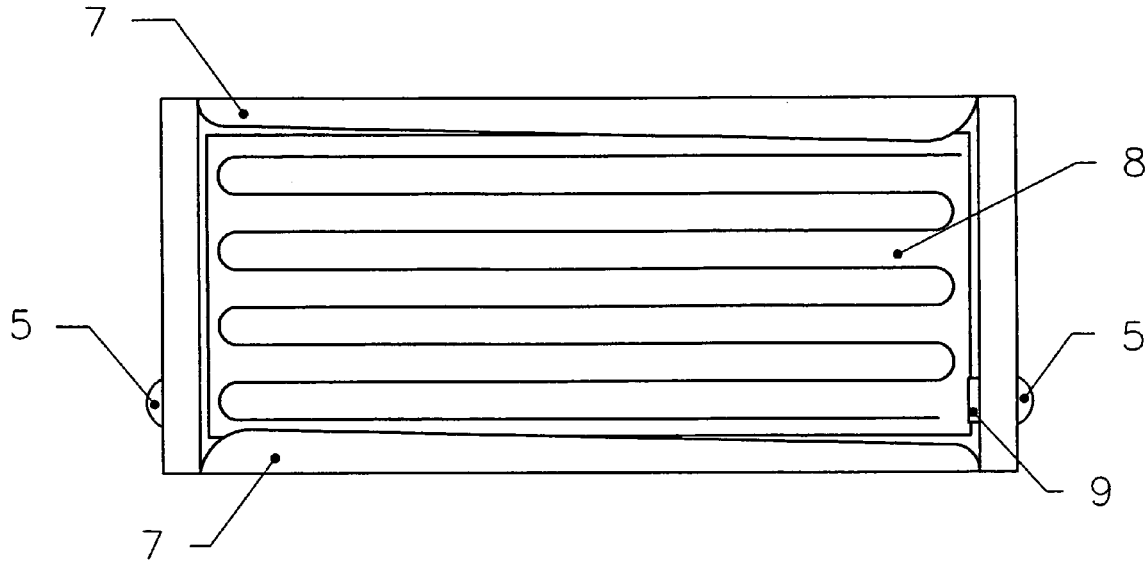
FIG. 3 is an internal view of the preferred embodiment of the heating element disposed within the heating container component of the present invention.

Next, FIG. 3 is a side view cut away of the internal components of heating box 3. While any practicable method of supporting golf balls in the heating box 3 would be acceptable, the preferred embodiment employs aluminum rails 7 attached in any effective manner to the interior walls of the heating box 3. The rails are positioned with a downward slope (preferably a 2% slope) to allow golf balls to roll and be easily collected by the user. A temperature sensitive sensor 9 controls the flow of electricity to the thermal resistor(s) 8 and thereby enables the heating box 3 to maintain a consistent temperature range. The thermal resistor(s) 8 will preferably have at least a −32 degrees to 200 degrees Fahrenheit operating range and be resistant to water.

In operation, the temperature sensitive sensor 9 activates the flow of electricity to the thermal resistor(s) 8 when the ambient temperature inside heating box 3 falls below 75 degrees Fahrenheit. Likewise, the sensor 9 causes electricity to the thermal resistors 8 to be shut off when the ambient temperature inside heating box 3 reaches 85 degrees Fahrenheit. In this way, an optimal temperature range is maintained inside the heating box 3. The circuitry 11 and 12 enabling the temperature sensitive sensor 9 to control the flow of electricity to the thermal resistor(s) 8 can be constructed from any commercially available circuitry components, and will typically be low voltage control signal wiring, typically 0V–5V.

Figure 4:
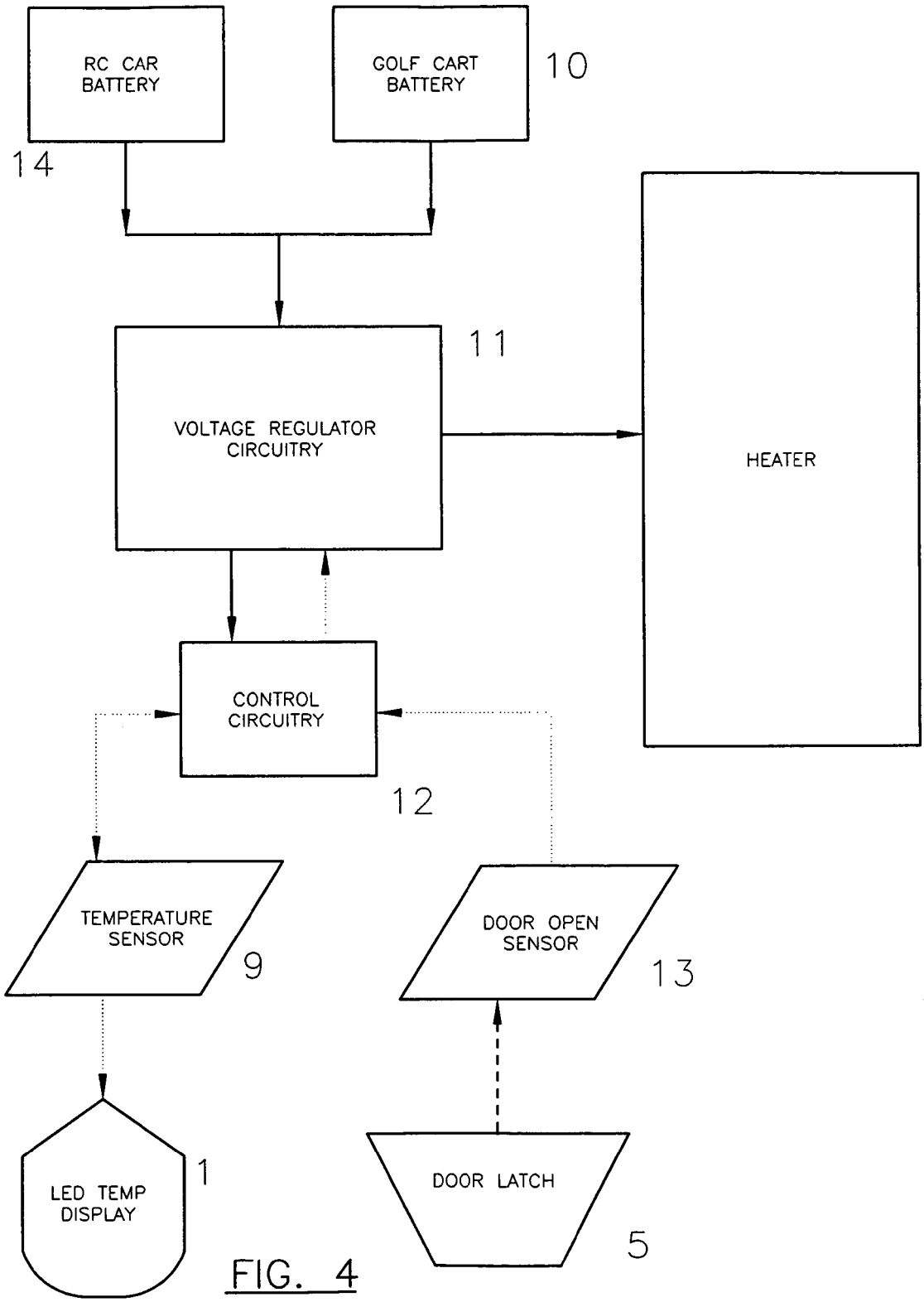
FIG. 4 is a diagram of the electrical connections employed in the preferred embodiment of the invention.

FIG. 4 is a diagram of the electrical connections used in the preferred embodiment of the invention. Here, a golf cart battery 10 or a RC Battery 14 provides electricity of any appropriate voltage (e.g., 12V, 24V, 36V or 48V) to the voltage regulator circuitry 11. The voltage regulator circuitry 11 is housed in the control box 2, and, in turn, provides power to both the control circuitry 12 (also in the control box 2) and to the thermal resistor(s) 8 located inside the heater 3. The control circuitry 12 monitors signals from both the temperature sensor 9 and a door open sensor 13. Upon receiving an open door signal from door open sensor 13, the control circuitry 12 causes the voltage regulator circuitry 11 to stop providing power to the thermal resistor(s) 8.

Likewise, an over-temperature signal from the temperature sensor 9 causes the control circuitry 12 to turn off the thermal resistor 8 power being supplied by the voltage regulator circuitry 11. Conversely, an under-temperature signal from the temperature sensor 9 will cause the control circuitry 12 to turn on voltage regulator circuitry 11 power to the thermal resistor(s) 8. In the preferred embodiment, the temperature sensor 9 sends an electrical control signal to the control circuitry 12 when the ambient temperature inside the heating box 3 falls below 75 degrees Fahrenheit. In that case, the control circuitry 12 causes power to be supplied to the thermal resistor(s) from the voltage regulator circuitry 11. When the temperature sensitive switch 9 detects an ambient temperature of at least 85 degrees Fahrenheit inside the heating box, the temperature sensitive sensor 9 sends an electrical control signal to the control circuitry 12 that causes the control circuitry 12 to turn off voltage regulator circuitry 11 power to the thermal resistor(s) 8.

Finally, the door open sensor 13 sends an electrical control signal to the control circuitry 12 when the sliding door of the heating box 3 is opened. This causes the control circuitry 12 to turn off voltage regulator circuitry 11 power to the thermal resistor(s) 8. The door open sensor 13 also detects whether or not the sliding door is in a closed position. Where the door is closed, the door open sensor 13 sends an electrical control signal to control circuitry 12, which causes the control circuitry 12 to turn on voltage regulator circuitry 11 power to the thermal resistor 8.

While the foregoing sections describe the preferred embodiment of the invention, those skilled in the art will immediately recognize that there are other ways that a device can be created to meet the objectives of the invention. The description of the preferred embodiment is therefore not in any way intended to limit the scope of the invention. Likewise, characteristics of the preferred embodiment described herein are not in any way intended to limit the claims unless the characteristic is explicitly described within the body of the claim itself. The wording of the claims of the invention and that alone defines the scope of the invention, and it is the inventor's intention to use words in the claims to express their plain and ordinary meaning from the perspective of one or ordinary skill in the art of the invention, contemplating expressly that said meaning is broader than the characteristics of the preferred embodiment described herein.

What is claimed is:

1. A golf ball heating device comprising:

a container having an interior outfitted with rails for holding golf balls and at least one heating element;

a sliding door at one end of the container;

a temperature sensitive sensor located within the interior of the container;

a push button lock mechanism equipped to selectively preclude the at least one heating element from receiving power;

a door open sensor for detecting whether or not the sliding door is in an open or closed position; and a control box affixed to the container and including;

voltage regulator circuitry electrically connected to the at least one heating element and equipped to receive power from an external power source; and control circuitry in electrical communication with each of the voltage regulator circuitry, the temperature sensitive sensor and the door open sensor.

2. The golf ball heating device of claim 1 further comprising means for indicating that the temperature in the interior of the container is within a desired temperature range.

3. The golf ball heating device of claim 1 further comprising an LED temperature display for displaying the temperature inside the container.

4. A golf ball heating system comprising:

a golf cart having one or more batteries and a power outlet coupled to the one or more batteries;

a container having an interior outfitted with rails for holding golf balls and at least one heating element;

a sliding door at one end of the container;

a temperature sensitive sensor located within the interior of the container;

a push button lock mechanism equipped to selectively preclude the at least one heating element from receiving power;

a door open sensor for detecting whether or not the sliding door is in an open or closed position; and a control box affixed to the container and including;

voltage regulator circuitry electrically connected to the at least one heating element and equipped to receive power from an external power source; and control circuitry in electrical communication with each of the voltage regulator circuitry, the temperature sensitive sensor and the door open sensor.

5. The golf ball heating system of claim 4 further comprising means for indicating that the temperature in the interior of the container is within a desired temperature range.

6. The golf ball heating system of claim 4 further comprising an LED temperature display for displaying the temperature inside the container.

7. A golf ball heating system comprising:

a portable battery pack having one or more batteries and a power outlet coupled to the one or more batteries;

a container having an interior outfitted with rails for holding golf balls and at least one heating element;

a sliding door at one end of the container;

a temperature sensitive sensor located within the interior of the container;

a push button lock mechanism equipped to selectively preclude the at least one heating element from receiving power;

a door open sensor for detecting whether or not the sliding door is in an open or closed position; and a control box affixed to the container and including;

voltage regulator circuitry electrically connected to the at least one heating element and equipped to receive power from an external power source; and control circuitry in electrical communication with each of the voltage regulator circuitry, the temperature sensitive sensor and the door open sensor.

8. The golf ball heating system of claim 7 further comprising means for indicating that the temperature in the interior of the container is within a desired temperature range.

9. The golf ball heating system of claim 7 further comprising an LED temperature display for displaying the temperature inside the container.

* * * * *